US006192691B1

(12) United States Patent
Nohmura

(10) Patent No.: US 6,192,691 B1
(45) Date of Patent: Feb. 27, 2001

(54) METHOD OF COLLECTING METHANE HYDRATE GAS AND APPARATUS THEREFOR

(75) Inventor: Ryotaro Nohmura, Osaka (JP)

(73) Assignee: Taiyo Kogyo Corporation, Osaka-fu (JP)

( * ) Notice: Subject to any disclaimer, the term of this patent is extended or adjusted under 35 U.S.C. 154(b) by 0 days.

(21) Appl. No.: 09/399,246

(22) Filed: Sep. 20, 1999

(51) Int. Cl.[7] ..... F17C 1/00
(52) U.S. Cl. ..... 62/53.1
(58) Field of Search ..... 62/53.1

(56) References Cited

U.S. PATENT DOCUMENTS 3,159,006 * 12/1964 Sliepcevich ..... 62/45
3,195,310 * 7/1965 Schoeder ..... 61/0.5
3,662,558 * 5/1972 Jackson ..... 61/0.5

* cited by examiner

*Primary Examiner*—William Doerrler
*Assistant Examiner*—Malik N. Drake
(74) *Attorney, Agent, or Firm*—Fattibene & Fattibene; Arthur T. Fattibene; Paul A. Fattibene

(57) ABSTRACT

Methane hydrate gas is trapped on the bottom of the sea or on the bottom of the water without releasing it into the open air. A sheet (flexible sheet) 2 is formed and is sunk on the bottom of the sea or on the bottom of the water to cover a predetermined area. The sheet 2 is spread on the bottom of the sea or on the bottom of the water to trap the methane hydrate gas inside the sheet 2 as the inside of the sheet 2 is lifted up by the buoyancy of methane gasified in the area on where the sheet 2 is spread.

8 Claims, 11 Drawing Sheets

METHOD OF COLLECTING METHANE HYDRATE GAS AND APPARATUS THEREFOR

BACKGROUND OF THE INVENTION

1. Field of the Invention

The present invention relates to a method of collecting methane hydrate gas hoarded in the bottom of the sea or in the bottom of the water, and an apparatus therefor.

2. Description of the Prior Art

Various methods have heretofore been studied for collecting methane hydrate gas. There has been known, for example, a method according to which hot seawater is injected into a methane hydrate layer in the bottom of the sea to change the temperature condition for the methane hydrate into a temperature at which the methane hydrate is decomposed into water and a methane hydrate gas, and the decomposed methane hydrate gas only is transported to a liquefying facility on the sea and is liquefied. There has further been known an apparatus for collection wherein a pair of transport pipes are extended from the facility on the sea to the methane hydrate layer, the seawater is injected into the methane hydrate layer through one transport pipe, and the other transport pipe is connected to the liquefying facility to collect the methane hydrate gas. As is well known, the methane hydrate is a product having a composition $CH_4 \cdot 6$ to $7\ H_2O$ and having affinity to water, and decomposes under a pressure of 8 kg/cm$^2$ at 0° C. producing heat of decomposition of 100 kcal/kg. However, it is difficult to correctly probe the pressure in the methane hydrate layer and the degree of stability of the layer from above the water or the sea. The transport pipes that are carelessly driven causes the methane hydrate gas to erupt on a large scale permitting a useful gas resource to be released into the open air accelerating the warming-up of the atmosphere.

Therefore, a technical problem is arousing that must be solved for trapping the methane hydrate gas on the bottom of the sea or on the bottom of the water using a flexible sheet. It is a first object of the present invention to solve the above-mentioned problem.

Another object of the present invention is to collect the methane hydrate gas trapped in the sheet by transporting it to above the water or the sea.

SUMMARY OF THE INVENTION

In order to accomplish the first object, the present invention provides a method of collecting methane hydrate gas by forming a sheet to cover the bottom of the sea or the bottom of the water over a predetermined area, sinking the sheet on the bottom of the sea or on the bottom of the water to spread it, and trapping the methane hydrate gas in the sheet as the interior of the sheet is lifted up by the buoyancy of the gasified methane over the area where the sheet is spread.

The invention further provides a method of collecting methane hydrate gas by stretching skeletal members for a sheet to form a dome for covering the bottom of the sea or the bottom of the water over a predetermined area, sinking said dome so as to be landed on a portion where the methane hydrate is hoarded in the bottom of the sea or in the bottom of the water, and trapping the gasified methane hydrate gas in said dome.

In order to accomplish another object, the present invention provides a method of collecting methane hydrate gas, wherein a gas transport pipe is connected to said sheet, and the methane hydrate gas trapped in said sheet is transported through said transport pipe to above the water or above the sea.

The invention further provides a method of collecting methane hydrate gas of any one of the above-mentioned methods, wherein the seawater, water or hot water of a temperature for gasifying the methane hydrate is continuously supplied to between said sheet and the bottom of the sea or the bottom of the water in order to forcibly gasify the methane hydrate.

In order to accomplish the first object, further, the present invention provides an apparatus for collecting methane hydrate gas comprising a sheet for covering the bottom of the sea or the bottom of the water over a predetermined area, a sheet-sinking means such as weights or anchors for spreading and sinking said sheet on the bottom of the sea or on the bottom of the water, and a guide means for guiding said weights to predetermined positions on the bottom of the sea or on the bottom of the water, wherein the portion where the methane hydrate is hoarded in the bottom of the sea or in the bottom of the water is covered with said sheet to trap the methane hydrate gas in the sheet as the interior of the sheet is lifted up by the buoyancy of the gasified methane hydrate.

The invention further provides an apparatus for collecting methane hydrate gas wherein skeletal members are stretched for a sheet to form a dome for covering the bottom of the sea or the bottom of the water over a predetermined area, sheet-sinking means such as weights or anchors are secured to said dome in order to sink the sheet together with the skeletal members on the bottom of the sea or on the bottom of the water, said dome is provided with a dome guide means for guiding the dome onto the portion where the methane hydrate is hoarded in the bottom of the sea or in the bottom of the water so as to be landed thereon, and said dome is landed on the portion where the methane hydrate is hoarded in the bottom of the sea or in the bottom of the water in order to trap the methane hydrate gas in the dome.

In order to accomplish another object, the present invention provides an apparatus for collecting methane hydrate gas wherein a gas transport pipe is connected to said sheet, said gas transport pipe extending from the bottom of the sea or from the bottom of the water to above the water or above the sea, and the methane hydrate gas trapped in said sheet is transported through said transport pipe.

The invention further provides an apparatus for collecting methane hydrate gas wherein a gas transport pipe is connected to said sheet, said gas transport pipe extending from the bottom of the sea or from the bottom of the water to above the water or above the sea, and the seawater, water or hot water of a temperature for gasifying the methane hydrate is supplied to between said sheet and the bottom of the sea or the bottom of the water through said transport pipe, in order to gasify the methane hydrate gas trapped in the bottom of the sea or in the bottom of the water.

DESCRIPTION OF THE PREFERRED EMBODIMENTS

An embodiment of the present invention will now be described in detail with reference to the accompanying drawings.

Figure 1:
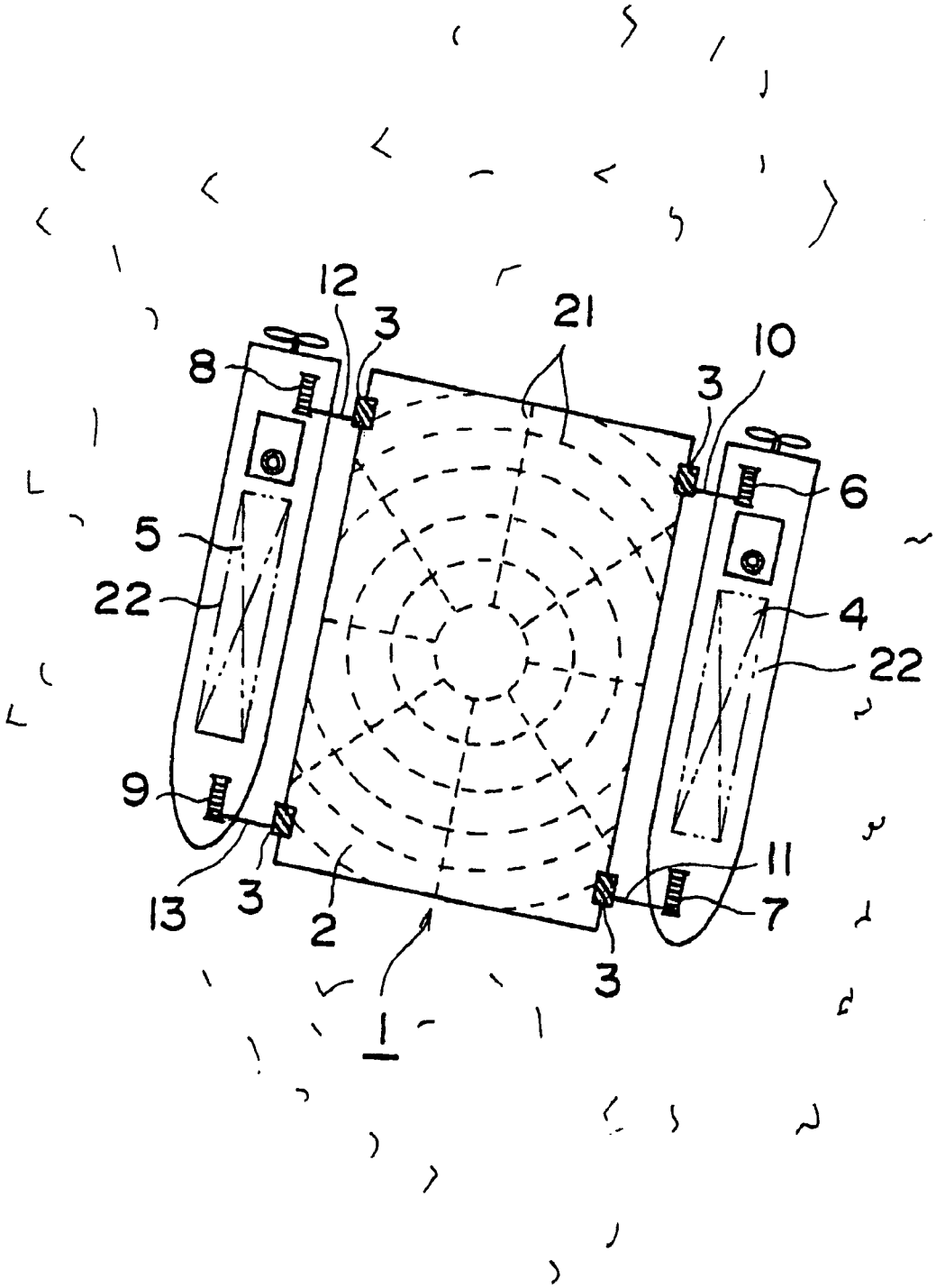
FIG. 1 is a plan view illustrating a state of before an apparatus for recovering methane hydrate gas is sunk according to an embodiment of the present invention.

FIG. 1 illustrates an apparatus 1 for recovering methane hydrate gas by forming a sheet 2 having a predetermined thickness, predetermined width and predetermined length with weights 3 at four corners of the sheet 2 as sheet anchoring means for anchoring and spreading the sheet 2. The sheet 2 will be a flexible sheet that remains flexible enough at a temperature deep in the water where the methane hydrate layer exists, such as woven fabric, net fabric, non-net fabric, or fabric thereof reinforced with woven yarns 21 of a reinforced fiber (such as carbon fiber or the like), or a flexible sheet member comprising these fabrics as a core member which is coated with a synthetic resin. As will be described later, when the methane hydrate gas is to be forcibly released by supplying hot water, the sheet members are overlapped in many layers, and a heat-insulating member such as foamed resin like foamed urethane is interposed among the sheet members to form heat-insulating layers in order to impart heat-insulating property. The thickness of the sheet 2 is exclusively determined based on the area of the methane hydrate gas layer in the bottom of the water or in the bottom of the sea and the amount of the methane hydrate gas held in the methane hydrate gas layer. For example, the thickness is selected to be from 1 mm to 5 mm, and the width and length of the sheet 2 are determined by the area of the methane hydrate gas layer and the amount of the methane hydrate gas that is held. When the width and length of the methane hydrate gas layer define an area of 20 $m^2$, for example, the width and length of the sheet 2 are selected to offer margin to cope with large-scale eruption of the methane hydrate gas. The area of the sheet 2 may be freely set, as a matter course, such as 5000 $m^2$ to 10000 $m^2$ to collect the methane hydrate gas on a large scale. The sheet 2 is not limited to a square shape or rectangular shape, but may have a circular shape or a polygonal shape.

The sheet 2 is transported by a transport ship (or a liquefied gas transport ship) to the water or the sea where the methane hydrate gas is buried, and is sunk in the water or onto the bottom of the sea due to the weight of the sheet-sinking means such as weights 3 or anchors.

To sink the sheet, winches at the bows and at the sterns of two transport ships (or liquefied gas transport ships) 4 and 5 are utilized as shown in FIG. 1.

First, ropes 10, 11, 12 and 13 of winches 6, 7, 8 and 9 of the two ships (or liquefied gas transport ships) 4 and 5 are delivered by a predetermined length and are stopped, and the ends of the ropes 10, 11, 12 and 13 are connected to corresponding sheet-sinking means such as weights 3 or anchors of the sheet 2. Next, the winches 6, 7, 8 and 9 are unwound to sink the sheet 2.

Figure 2:
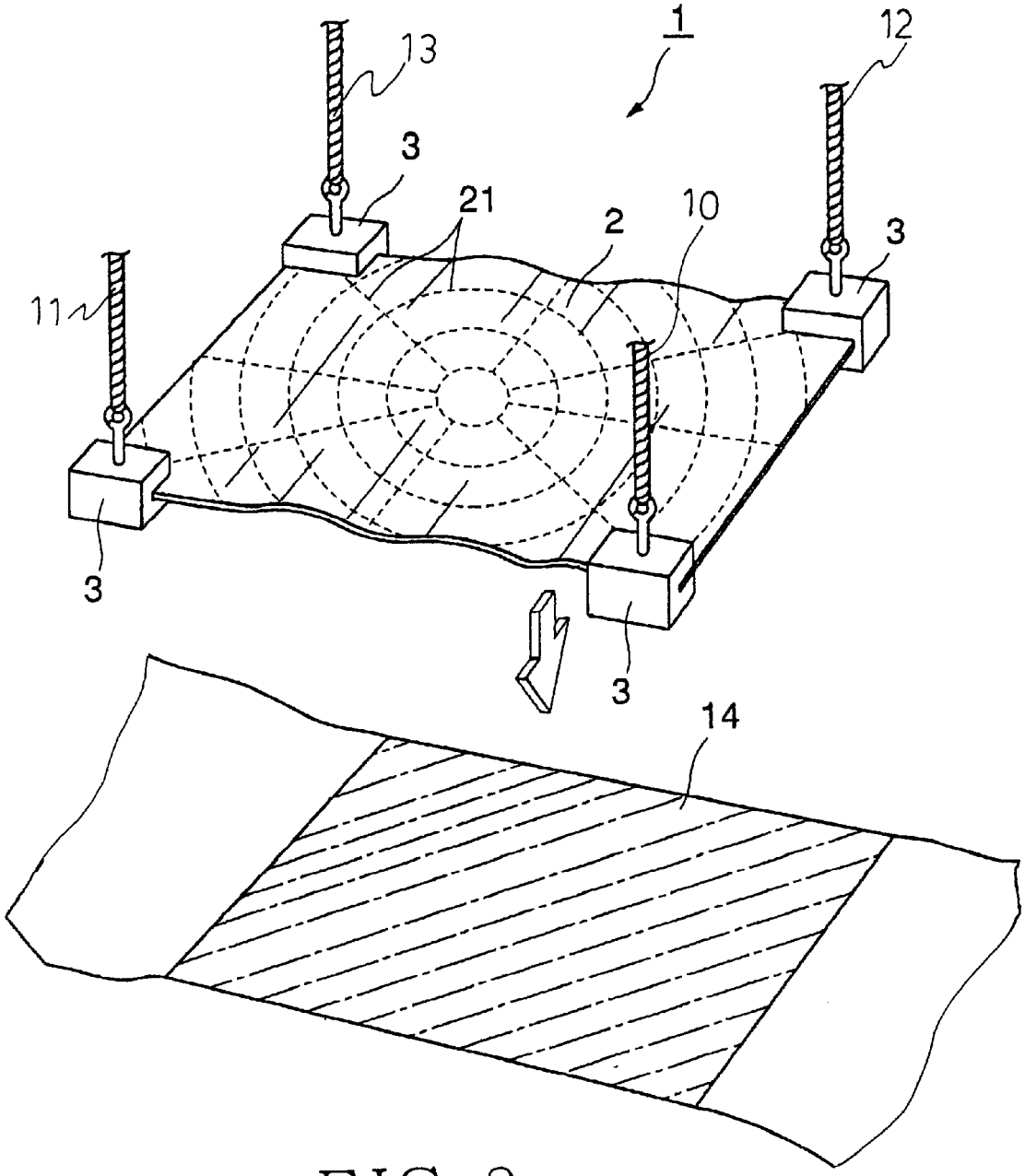
FIG. 2 is a perspective view illustrating a state of before an apparatus for recovering methane hydrate gas is sunk according to the embodiment of the present invention.

When the sheet 2 is to be spread and sunk while being maintained nearly horizontally, the winches 6, 7, 8 and 9 are unwound or wound to nearly horizontally spread the sheet 2. After the sheet 2 has been spread, the winches 6, 7, 8 and 9 of the two transport ships (or liquefied gas transport ships ) 4 and 5 are unwound at the same speed, and the sheet 2 is sunk onto the bottom of the water or onto the bottom of the sea by the weight of weights 3, 3, 3 and 3 or anchors while maintaining the sheet 2 horizontal. Thus, the sheet 2 sinks onto the bottom of the water or onto the portion 14 where the methane hydrate is hoarded as shown in FIG. 2. When it is confirmed that the weights 3, 3, 3 and 3 have landed on the portion 14 where the metal hydrate is hoarded due to the slackening of the ropes 10, 11, 12 and 13, the ropes 10, 11, 12 and 13 are no more delivered. Thereafter, the landed position of the sheet 2 is corrected as required.

For example, the position of the sheet 2 in the back-and-forth direction is corrected relative to the portion 14 where the methane hydrate is hoarded by unwinding the winches 6 and 7 of one transport ship 4 and by winding the winches 8 and 9 of the other transport ship 5. As required, further, the position in the right-and-left direction is corrected by winding and unwinding the winch on the side of the stern or bow and by winding and unwinding the winch of the other side of the transport ships 4 and 5.

When the sheet 2 is to be sunk in a state of being inclined relative to the horizontal plane, the winches 6, 7, 8 and 9 of the two transport ships (or liquefied gas transport ships) 4 and 5 are unwound or wound to incline the sheet 2 relative to the horizontal plane. Thereafter, the winches 6, 7, 8 and 9 on the side of the bow or the stern are unwound at the same speed, so that the sheet 2 is sunk on the bottom of the water or on the bottom of the sea due to the weight of the weights 3, 3, 3 and 3 while maintaining the inclination of the sheet 2 relative to the horizontal plane.

When it is confirmed that the weights 3 and 3 have landed on the portion 14 where the methane hydrate is hoarded as indicated by, for example, the slackening of the ropes on the side of the sheet 2 sinking first, the ropes 10 and 12 are not delivered any more. Thereafter, when it is confirmed that the weights 3 and 3 have landed on the portion 14 where the methane hydrate is hoarded as indicated by the slackening of the ropes 11 and 13, the ropes 11 and 13 are not delivered any more. Then, the winches 6 and 7 of one transport ship 4 are unwound and the winches 8 and 9 of the other transport ship 5 are wound to correct the position of the sheet 2 in the right-and-left direction relative to the portion 14 where the methane hydrate is hoarded. As required, further, the position of the sheet 2 in the back-and-forth direction is corrected by moving the two transport ships 4 and 5 back and forth.

After the landed position of the sheet 2 is confirmed or the landed position is corrected, the ropes 10, 11, 12 and 13 are disconnected from the winches 6, 7, 8 and 9 of the transport ships 4 and 5. Then, buoys (not shown) that serve as markers are attached to the ends of the ropes 10, 11, 12 and 13, so that the ends of the ropes 10, 11, 12 and 13 remain afloat on the water or on the seawater.

Figure 3A:
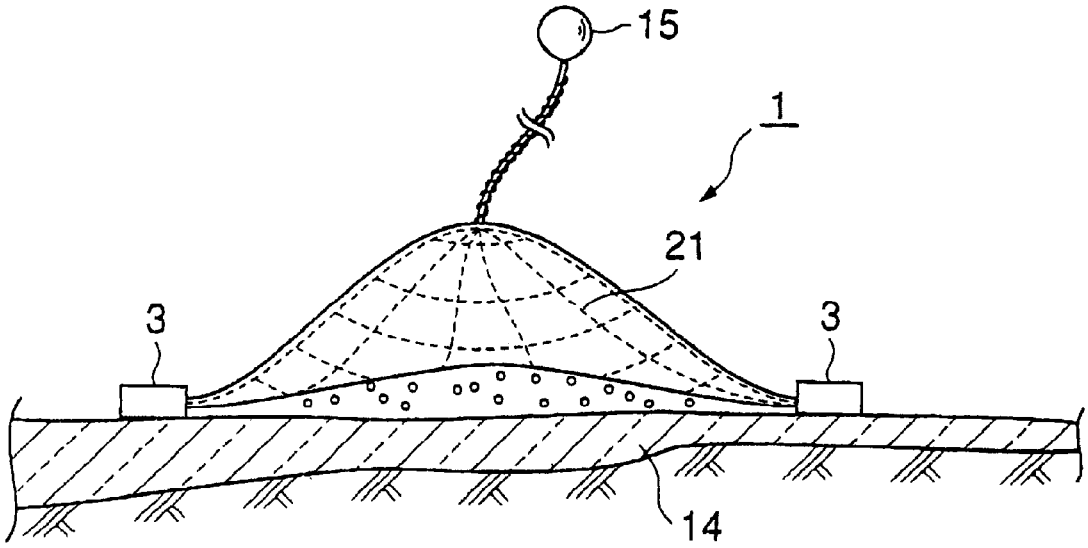
FIG. 3 is a side view illustrating a state of collecting methane hydrate gas by using the apparatus for recovering methane hydrate gas according to the embodiment of the present invention.
Figure 3B:
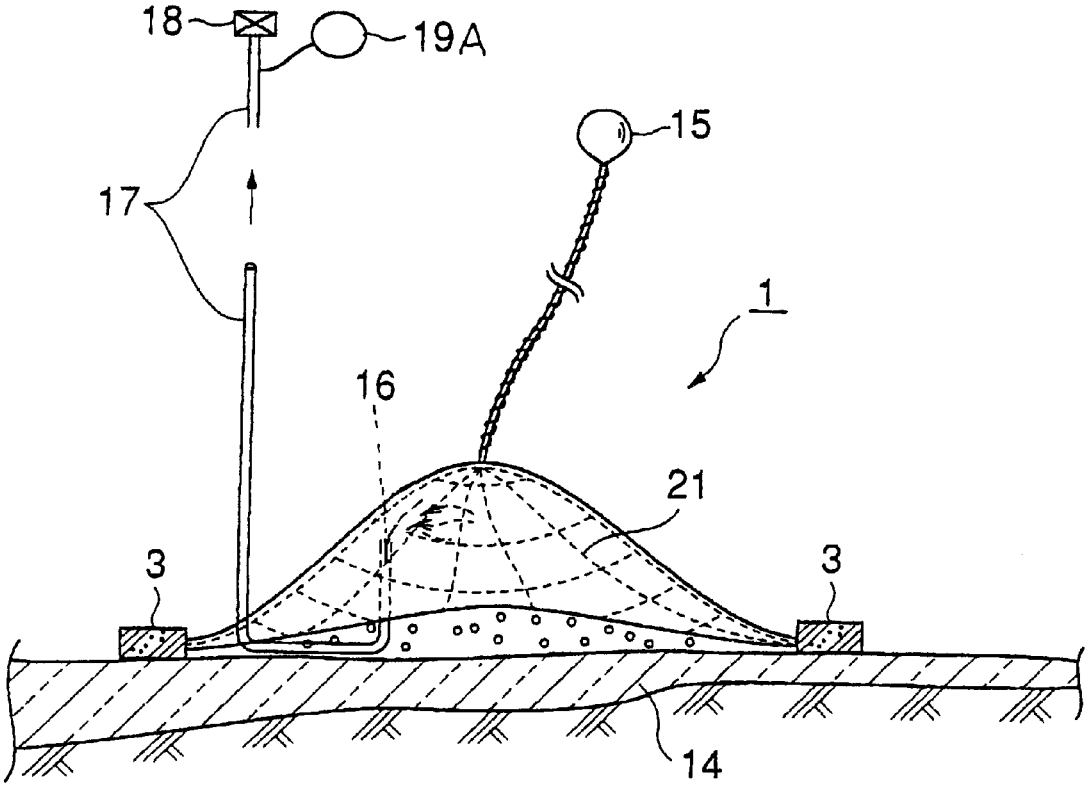

FIGS. 3(*a*) and 3(*b*) illustrate a state of trapping methane hydrate gas by the apparatus 1 comprising the sheet 2 and the weights 3, 3, 3 and 3 for correcting methane hydrate gas.

As shown, the outer peripheries of the sheet 2 are fixed on the portion 14 where the methane hydrate is hoarded by sheet-sinking means such as weights 3, 3, 3 and 3 or anchors. In this state, the central side of the sheet 2 is in a state of being freely floated due to the slackening of the sheet 2. Accordingly, the central side of the sheet 2 gradually rises with the passage of time due to the buoyancy of methane gas released from the portion 14 where the methane hydrate is hoarded and, finally, assumes the shape of a dome as shown in FIG. 3.

Figure 5:
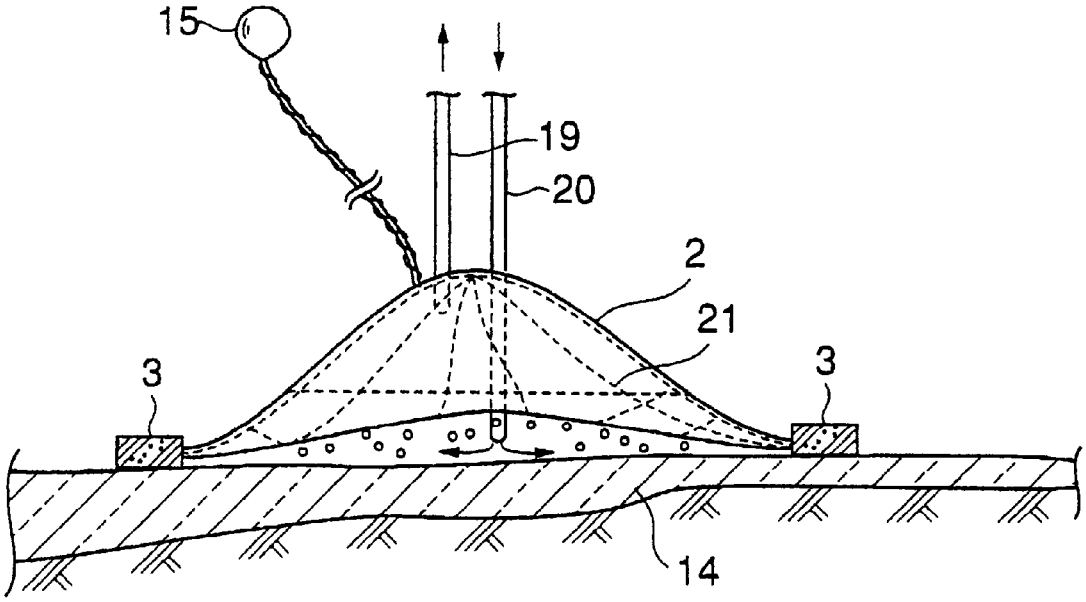
FIG. 5 is a side view illustrating an embodiment of the present invention in which hot water is transported through a transport pipe so that the methane hydrate gas is forcibly released.

To collect the liquefied gas as shown in FIG. 3(*b*), a transport pipe 17 is extended from the bottom of the water or the bottom of the sea to above the water or the sea, the transport pipe 17 having a suction port 16 between the sheet 2 and the portion 14 where the methane hydrate is hoarded and, preferably, at an upper part at the central portion in the sheet 2. To the end of the transport pipe 17 are attached a connection device 18 and a second buoy 19A for floating the connection device 18 on the surface of the water or on the surface of the sea. To collect the methane hydrate gas, therefore, the connection device 18 is connected to the gas liquefying facilities 22 in the transport ships 4 and 5 (or to the liquefying facilities (refrigerators) 22 of the liquefied gas transport ships). The collected methane hydrate gas is then liquefied and is transported to a near gas base. In order to favorably install the transport pipe 17, in this case, a transport pipe 19 extending from the bottom of the water or the bottom of the sea to above the water or the sea may be connected to the central portion of the sheet 2 in advance, and the second buoy 19A and the connection device 18 may be attached to the end of the transport pipe 19. It is further possible to forcibly release the methane hydrate gas instead of waiting for its spontaneous release, in order to collect the methane hydrate gas at one time. In this case as shown in FIG. 5, a hot water transport pipe 20 is connected, in addition to the transport pipe 19, to the central portion of the sheet 2 to supply hot water (water or seawater) of a temperature for forcibly releasing the methane hydrate gas by heating the portion 14 where the methane hydrate is hoarded. Then, hot water is continuously supplied for a predetermined period of time to between the sheet 2 and the portion 14 where the methane hydrate is hoarded through the hot water transport pipe 20, so that the methane hydrate gas is forcibly released from the portion 14 where the methane hydrate is hoarded. When the methane hydrate gas is collected in the sheet 2, the gas transport pipe 19 is connected to the gas liquefying facility 22 on the transport ship (gas liquefying facility on the liquefied gas transport ship) through the connection device 18 in order to collect and liquefy the methane hydrate gas. The sheet 2 has an area large enough to cope with a large-scale eruption of the methane hydrate gas.

Figure 6:
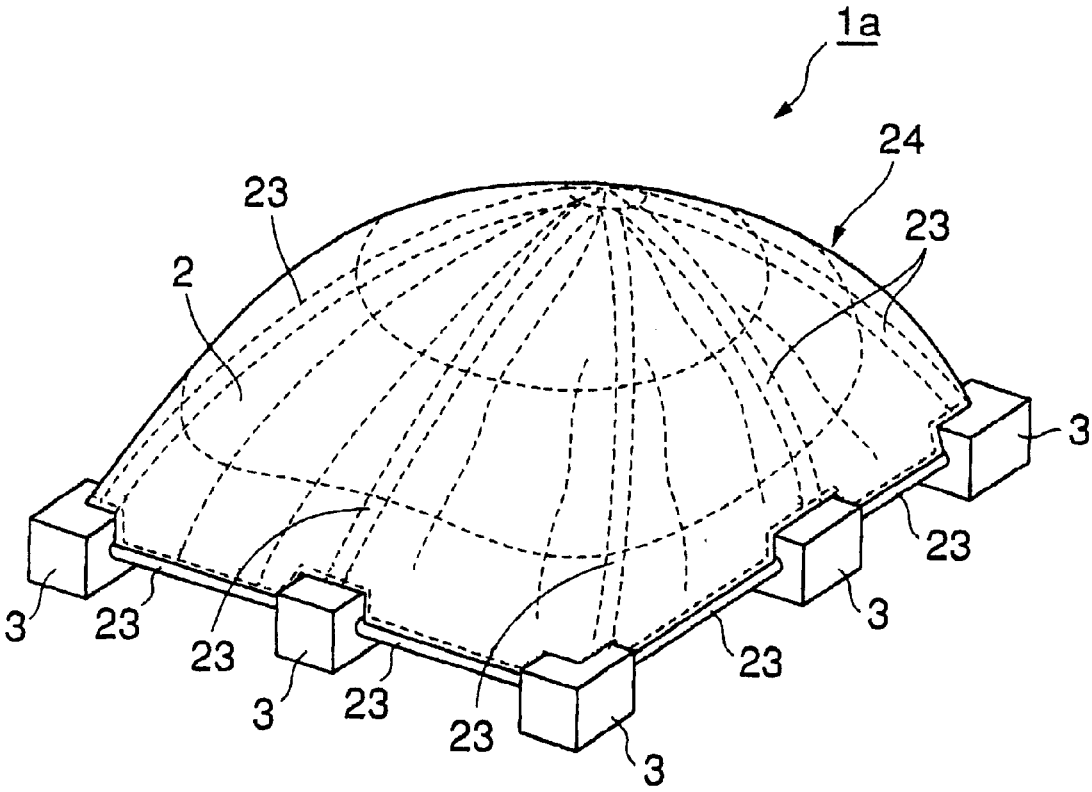
FIG. 6 is a perspective view illustrating an apparatus for collecting methane hydrate gas constituted in the form of a dome using skeletal members according to another embodiment of the present invention.
Figure 7:
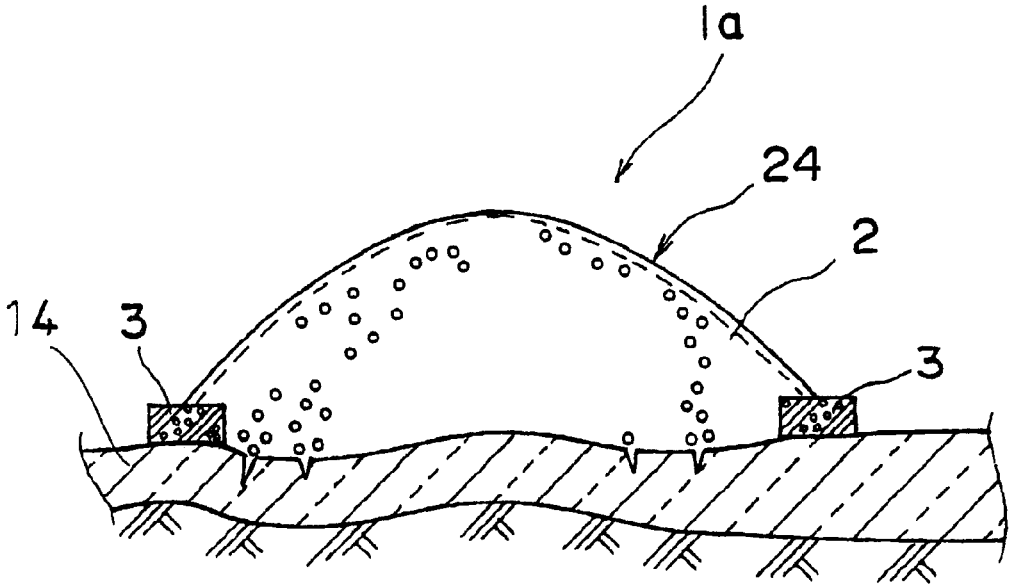
FIG. 7 is a side view illustrating a state of collecting the methane hydrate gas by the apparatus for collecting methane hydrate gas constituted in the form of a dome using skeletal members according to the embodiment of the present invention.

FIGS. 6 and 7 illustrate another apparatus 1*a* for correcting methane hydrate gas comprising the sheet 2, skeletal members 23, and sinking means such as weights 3 or anchors. A dome 24 for recovering the methane hydrate gas is constructed in advance by the sheet 2, skeletal members 23, and weights 3. The dome is then sunk by using winches 6, 7, 8 and 9 of the transport ships (or liquefied gas transport ships ) 4 and 5 and by using ropes 10, 11, 12 and 13. In this case, the skeletal members 23 are constituted by rods or pipes of a rust-free metal such as a stainless steel (SUS 304 or higher) or an aluminum alloy (duralumin or the like). The dome 24 is constructed by using skeletal members 23 in, for example, a conical shape or a polygonal shape. The sheet 2 is stretched to the inside or outside of the skeletal members from the inside or the outside, and weights 3 or anchors of concrete blocks are attached to the bottom side portions of the skeletal structure. The methane hydrate gas is transported from the dome 24 to the base by using the transport ships (or liquefied gas transport ships) 4 and 5 as described above. The dome 24 is sunk and its position is corrected in the same manner as those of the above-mentioned embodiment.

Figure 8:
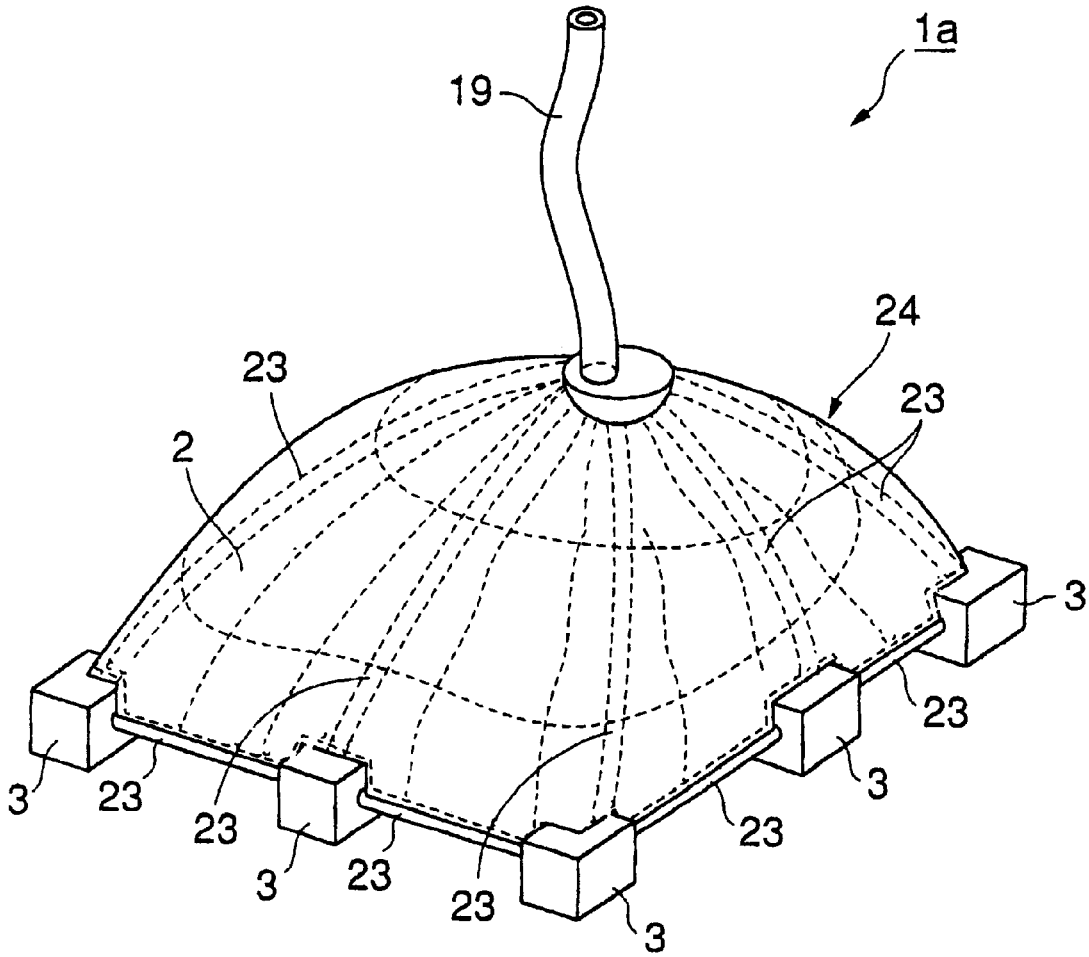
FIG. 8 is a perspective view illustrating a state where a gas transport pipe is attached to improve the methane hydrate gas recovery efficiency in the apparatus for collecting methane hydrate gas constituted in the form of a dome using skeletal members according to the embodiment of the present invention.
Figure 9:
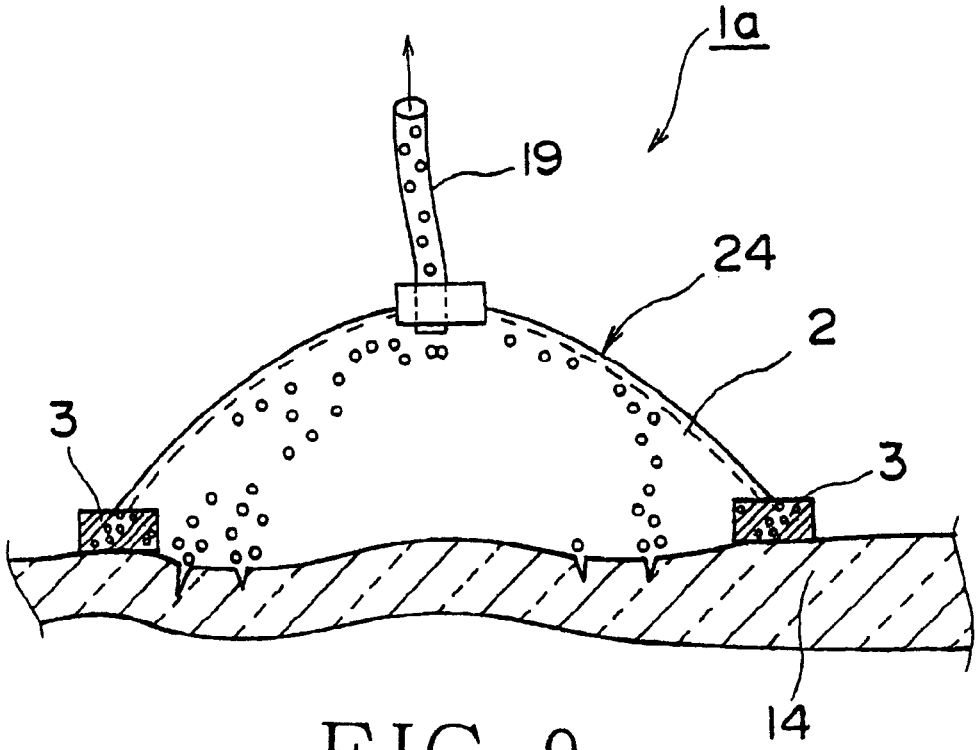
FIG. 9 is a perspective view illustrating a state of collecting methane hydrate gas by attaching the gas transport pipe to the apparatus for collecting methane hydrate gas constituted in the form of a dome using skeletal members according to the embodiment of the present invention.
Figure 10:
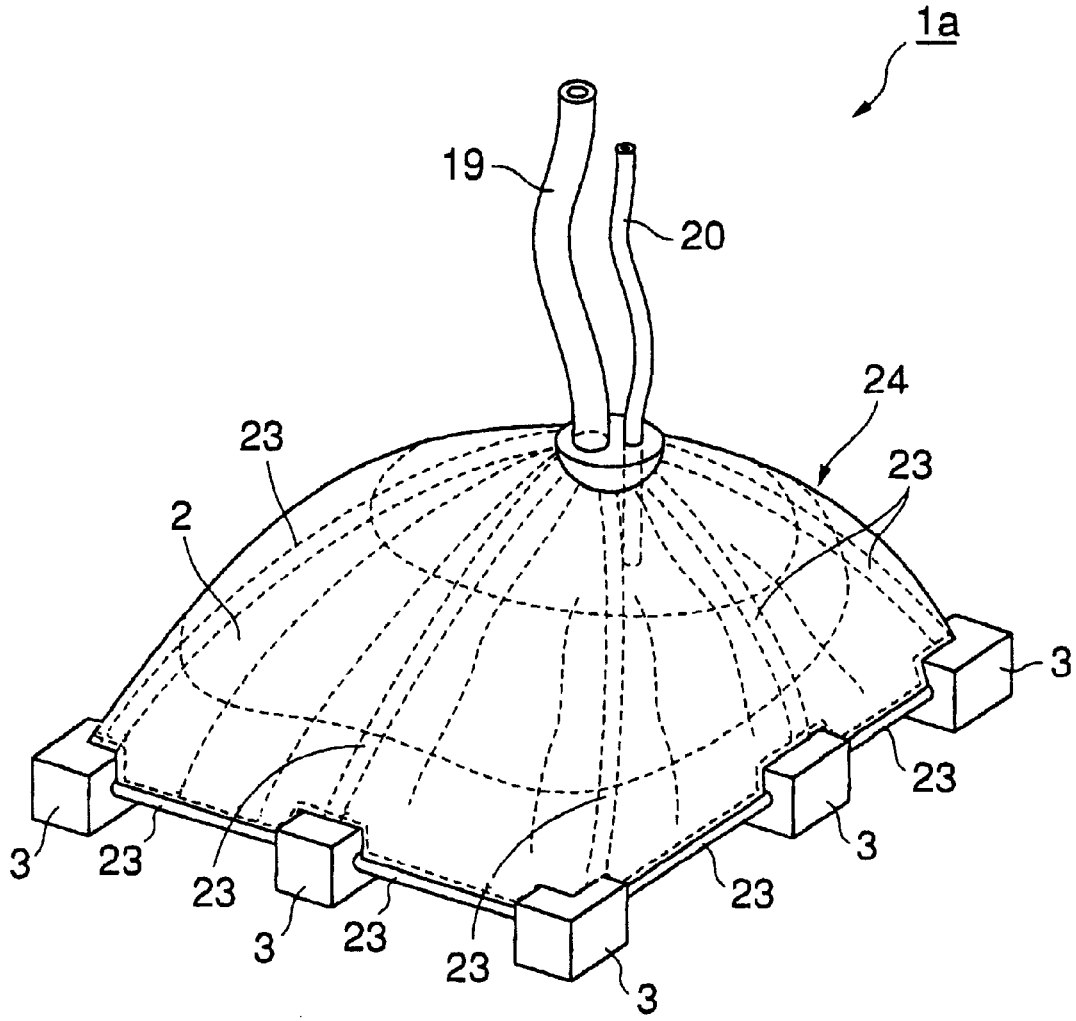
FIG. 10 is a perspective view illustrating a state where a hot water transport pipe is attached, in addition to the gas transport pipe, to the apparatus for collecting methane hydrate gas constituted in the form of a dome using skeletal members according to the embodiment of the present invention.
Figure 11:
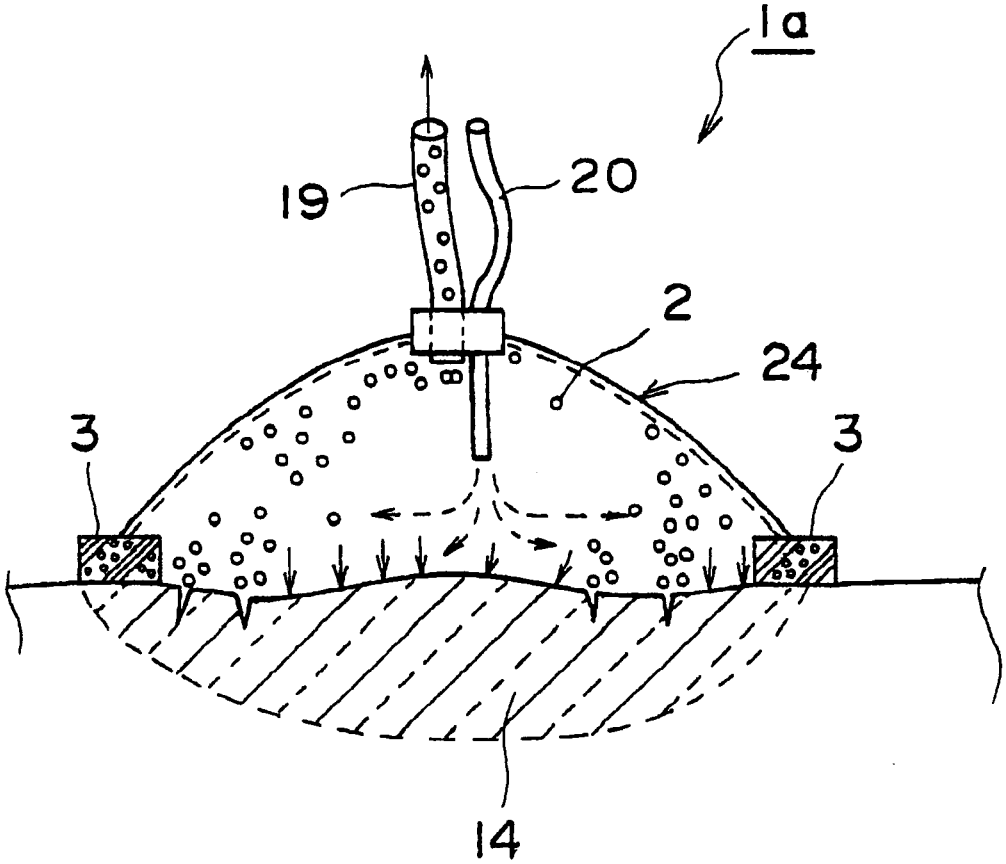
FIG. 11 is a side view illustrating a state of collecting methane hydrate gas by attaching the hot water transport pipe, in addition to the gas transport pipe, to the apparatus for collecting methane hydrate gas constituted in the form of a dome using skeletal members according to the embodiment of the present invention.

As shown in FIGS. 8 and 9, it is of course allowable to connect the methane hydrate gas transport pipe 19 to the central portion of the sheet 2 and transport the methane hydrate gas to the gas liquefying facilities 22 on the transport ships (liquefied gas transport ships) 4 and 5 through the gas transport pipe 19 to liquefy it. As shown in FIGS. 10 and 11, further, it is also allowable to connect the hot water transport pipe 20 together with the methane hydrate gas transport pipe 19 to continuously supply hot water into the dome 24, so that the methane hydrate gas is forcibly released from the portion 14 where the methane hydrate is hoarded and that the released methane hydrate gas is liquefied through the same liquefying facility 22 as the one described above and is transported.

In this embodiment, too, the opening area and volume of the dome 24 are determined in advance to cope with the abrupt eruption of the methane hydrate gas from the portion 14 where the methane hydrate gas is hoarded.

Figure 4:
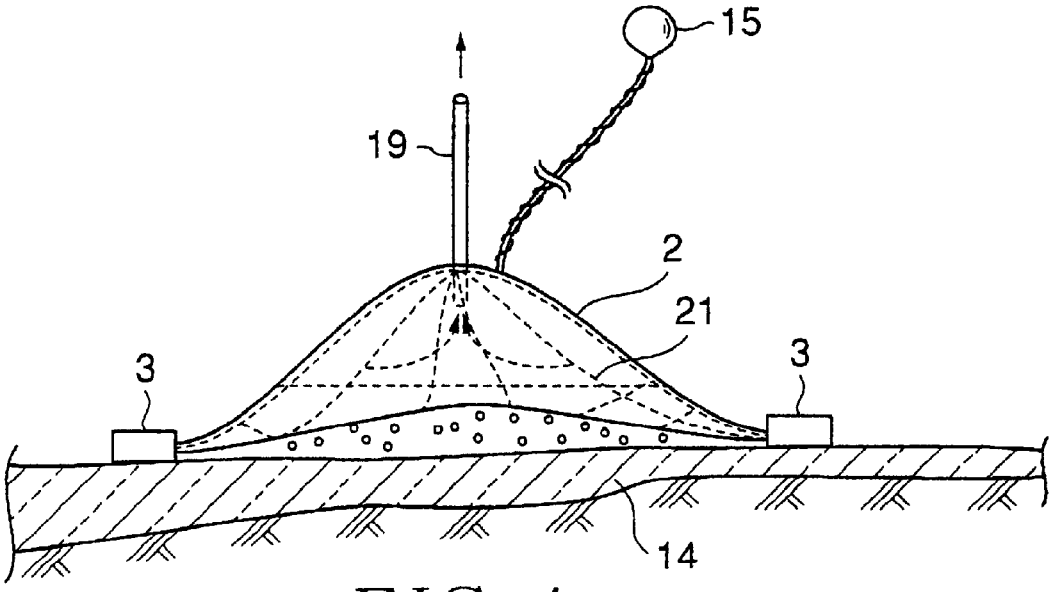
FIG. 4 is a side view illustrating a constitution for correcting the methane hydrate gas through a transport pipe according to the embodiment of the present invention.

According to this embodiment, too, therefore, the methane hydrate gas can be favorably collected without excavating the bottom of the sea while limiting the methane hydrate gas from being released into the open air. As shown in FIGS. 3 to 5, further, a buoy 15 may be attached via a rope to the central portion of the sheet 2 to forcibly pull up the central portion of the sheet 2 by the buoyancy of the buoy 15 from the bottom of the water or the bottom of the sea toward the surface of the water or the surface of the sea, thereby to form a dome for collecting the methane hydrate gas. In this case, the skeletal members 23 may be decreased or eliminated. In the above-mentioned embodiments, additionally elongated portions may be formed between the sheet 2 and the sheet-sinking means such as weights 3 or anchors so that when the sheet 2 is landed, the additionally elongated portions are landed in a folded manner on the portion 14 where the methane hydrate gas is hoarded. This constitution positively prevents the leakage of the methane hydrate gas and the leakage of hot water. Though the foregoing embodiments have dealt with the use of transport ships as another means for transporting the sheet 2 and for sinking the sheet 2 on the bottom of the water or on the bottom of the sea, it is also allowable to use helicopters.

According to the inventions of claims 1, 2, 5 and 6 as described above, it is made possible to recover the methane hydrate gas without excavating the bottom of the sea and without releasing the precious gas resource to the open air, as well as to cope with the sudden eruption of the methane hydrate gas, presenting great effects.

According to the inventions of claims 3 and 7, it is made possible to improve the efficiency for recovering the methane hydrate gas. According to the inventions of claims 4 and 8, the methane hydrate gas can be collected within short periods of time, offering a great effect.

It should here be noted that the present invention can be modified in a variety of ways without departing from the spirit of the invention and that the invention encompasses the modified embodiments, as a matter of course.

I claim:

1. A method of collecting methane hydrate gas by forming a sheet to cover the bottom of the sea or the bottom of the water over a predetermined area, sinking the sheet on the bottom of the sea or on the bottom of the water to spread it, and trapping the methane hydrate gas in the sheet as the interior of the sheet is lifted up by the buoyancy of the gasified methane over the area where the sheet is spread.

2. A method of collecting methane hydrate gas by stretching skeletal members for a sheet to form a dome for covering the bottom of the sea or the bottom of the water over a predetermined area, sinking said dome so as to be landed on a portion where the methane hydrate is held in the bottom of the sea or in the bottom of the water, and trapping the gasified methane hydrate gas in said dome.

3. A method of collecting methane hydrate gas according to claim 1 or 2, wherein a gas transport pipe is connected to said sheet, and the methane hydrate gas trapped in said sheet is transported through said transport pipe to above the water or above the sea.

4. A method of collecting methane hydrate gas according to any one of claims 1 to 3, wherein the seawater, water or hot water of a temperature for gasifying the methane hydrate is continuously supplied to between said sheet and the bottom of the sea or the bottom of the water in order to forcibly gasify the methane hydrate.

5. An apparatus for collecting methane hydrate gas comprising a sheet for covering the bottom of the sea or the bottom of the water over a predetermined area, a sheet-sinking means such as weights or anchors for spreading and sinking said sheet on the bottom of the sea or on the bottom of the water, and a guide means for guiding said weights to predetermined positions on the bottom of the sea or on the bottom of the water, wherein the portion where the methane hydrate is hoarded in the bottom of the sea or in the bottom of the water is covered with said sheet to trap the methane hydrate gas in the sheet as the interior of the sheet is lifted up by the buoyancy of the gasified methane hydrate.

6. An apparatus for collecting methane hydrate gas wherein skeletal members are stretched for a sheet to form a dome for covering the bottom of the sea or the bottom of the water over a predetermined area, sheet-sinking means such as weights or anchors are secured to said dome in order to sink the sheet together with the skeletal members on the bottom of the sea or on the bottom of the water, said dome is provided with a dome guide means for guiding the dome onto the portion where the methane hydrate is hoarded in the bottom of the sea or in the bottom of the water so as to be landed thereon, and said dome is landed on the portion where the methane hydrate is hoarded in the bottom of the sea or in the bottom of the water in order to trap the methane hydrate gas in the dome.

7. An apparatus for collecting methane hydrate gas according to claim 5 or 6, wherein a gas transport pipe is connected to said sheet, said gas transport pipe extending from the bottom of the sea or from the bottom of the water to above the water or above the sea, and the methane hydrate gas trapped in said sheet is transported through said transport pipe.

8. An apparatus for collecting methane hydrate gas a according to any one of claims 5 to 7, wherein a gas transport pipe is connected to said sheet, said gas transport pipe extending from the bottom of the sea or from the bottom of the water to above the water or above the sea, and the seawater, water or hot water of a temperature for gasifying the methane hydrate is supplied to between said sheet and the bottom of the sea or the bottom of the water through said transport pipe, in order to gasify the methane hydrate gas trapped in the bottom of the sea or in the bottom of the water.

* * * * *